US011448045B2

(12) United States Patent
Montoya Ashton et al.

(10) Patent No.: US 11,448,045 B2
(45) Date of Patent: Sep. 20, 2022

(54) DIRECTLY INITIATED ADDRESSABLE POWER CHARGE

(71) Applicant: Hunting Titan, Inc., Pampa, TX (US)

(72) Inventors: Laura Montoya Ashton, Ithaca, NY (US); Richard Wayne Bradley, Magnolia, TX (US); Christopher Brian Sokolove, Midlothian, TX (US); Isaiah Acevedo, Chandler, AZ (US); Johnny Covalt, Burleson, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 17/491,171

(22) Filed: Sep. 30, 2021

(65) Prior Publication Data

US 2022/0025743 A1 Jan. 27, 2022

Related U.S. Application Data

(63) Continuation of application No. 17/364,650, filed on Jun. 30, 2021, which is a continuation of application No. 16/098,381, filed as application No. PCT/US2017/031102 on May 4, 2017, now Pat. No. 11,053,783.

(60) Provisional application No. 62/331,555, filed on May 4, 2016.

(51) Int. Cl.

| | |
|---|---|
| ***E21B 43/1185*** | (2006.01) |
| ***E21B 23/04*** | (2006.01) |
| ***E21B 43/117*** | (2006.01) |
| *F42D 1/045* | (2006.01) |
| *F42B 3/12* | (2006.01) |

(52) U.S. Cl.
CPC ..... *E21B 43/1185* (2013.01); *E21B 23/0414* (2020.05); *E21B 43/117* (2013.01); *F42B 3/12* (2013.01); *F42D 1/045* (2013.01)

(58) Field of Classification Search
CPC .... E21B 23/065; E21B 23/04; E21B 23/0414; E21B 29/02; E21B 43/1185; E21B 43/117
See application file for complete search history.

(56) References Cited

U.S. PATENT DOCUMENTS

| | | | |
|---|---|---|---|
| 2,363,234 | A | 11/1944 | Doll |
| 3,038,303 | A | 6/1962 | Gose |
| 4,572,288 | A | 2/1986 | Kinley |
| 4,777,878 | A | 10/1988 | Johnson et al. |
| 5,287,920 | A | 2/1994 | Terrell |
| 5,392,860 | A | 2/1995 | Ross |
| 5,396,951 | A | 3/1995 | Ross |
| 5,908,365 | A | 6/1999 | LaJaunie et al. |

(Continued)

FOREIGN PATENT DOCUMENTS

WO 2015052509 A2 4/2015

OTHER PUBLICATIONS

Notification of transmittal of the International Search Report and the Written Opinion of the International Searching Authority, or the Declaration, PCT application No. PCT/US17/31102 dated Aug. 1, 2017, 11 pages.

(Continued)

*Primary Examiner* — Shane Bomar

(57) ABSTRACT

A method and apparatus for detonating a power charge in downhole wellbore using a heating element embedded within the energetic material of the power charge.

28 Claims, 1 Drawing Sheet

(56) References Cited

U.S. PATENT DOCUMENTS

| | | | | |
|---|---|---|---|---|
| 6,315,043 | B1 | 11/2001 | Farrant et al. | |
| 6,385,031 | B1 | 5/2002 | Lerche et al. | |
| 6,536,524 | B1 | 3/2003 | Snider | |
| 6,925,937 | B2 | 8/2005 | Robertson | |
| 9,598,942 | B2 | 3/2017 | Wells et al. | |
| 10,472,939 | B2 | 11/2019 | Sullivan et al. | |
| 11,204,224 | B2 * | 12/2021 | McNelis | E21B 41/0085 |
| 2003/0047312 | A1 | 3/2003 | Bell | |
| 2011/0132223 | A1 * | 6/2011 | Streibich | C06B 33/02 102/531 |
| 2011/0259230 | A1 | 10/2011 | Sawka et al. | |
| 2012/0037360 | A1 | 2/2012 | Arizmendi, Jr. et al. | |
| 2014/0338894 | A1 | 11/2014 | Mace et al. | |
| 2014/0345847 | A1 | 11/2014 | Picciotti et al. | |
| 2015/0330171 | A1 | 11/2015 | Cannon et al. | |
| 2015/0345922 | A1 | 12/2015 | Lanclos et al. | |
| 2016/0115753 | A1 | 4/2016 | Frazier et al. | |
| 2018/0087330 | A1 | 3/2018 | Bradley et al. | |
| 2018/0202249 | A1 | 7/2018 | Harrington et al. | |
| 2019/0353013 | A1 | 11/2019 | Sokolove et al. | |
| 2020/0166320 | A1 | 5/2020 | Henke et al. | |
| 2021/0355773 | A1 * | 11/2021 | Eitschberger | E21B 41/0085 |
| 2022/0049566 | A1 * | 2/2022 | Rairigh | E21B 29/02 |
| 2022/0049588 | A1 * | 2/2022 | Sampson | E21B 43/1185 |

OTHER PUBLICATIONS

Communication with Supplementary European Search Report, EP17793361.1 dated Nov. 13, 2019, 7 pages.

Office action, Canadian application No. 3,022,946, dated Sep. 20, 2019, 4 pages.

Response to Canadian office action, Canadian application No. 3,022,946, dated Jan. 20, 2020, 6 page.

Office action dated Dec. 8, 2020 in U.S. Appl. No. 16/098,381, 21 pages.

Response to office action dated Dec. 8, 2020 in U.S. Appl. No. 16/098,381, filed Mar. 8, 2021, 11 pages.

Reply to the EESR dated Nov. 13, 2019 and the communication under Rules 70(2) and 70a(2) EPC dated Dec. 12, 2019, EP17793361.1, filed Jun. 5, 2020, 23 pages.

* cited by examiner

DIRECTLY INITIATED ADDRESSABLE POWER CHARGE

RELATED APPLICATIONS

This application is a continuation of U.S. Nonprovisional patent application Ser. No. 17/364,650, filed Jun. 30, 2021, which is a continuation of U.S. Nonprovisional patent application Ser. No. 16/098,381, filed Nov. 1, 2018, now U.S. Pat. No. 11,053,783 issued on Jul. 6, 2021, which is a 371 of International Application No. PCT/US17/31102, filed May 4, 2017, which claims priority to U.S. Provisional Application No. 62/331,555, filed on May 4, 2016.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused explosive output. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates the liner metal is compressed into a super-heated, super pressurized jet that can penetrate metal, concrete, and rock.

A perforating gun has a gun body. The gun body typically is composed of metal and is cylindrical in shape. Within a typical gun tube is a charge holder or carrier tube, which is a tube that is designed to hold the actual shaped charges. The charge holder will contain cutouts called charge holes where the shaped charges will be placed.

A shaped charge is typically detonated by a booster or igniter. Shaped charges may be detonated by electrical igniters, pressure activated igniters, or detonating cord. One way to ignite several shaped charges is to connect a common detonating cord that is placed proximate to the igniter of each shaped charge. The detonating cord is comprised of material that explodes upon ignition. The energy of the exploding detonating cord can ignite shaped charges that are properly placed proximate to the detonating cord. Often a series of shaped charges may be daisy chained together using detonating cord.

Another type of explosive used in completions is a jet cutter. This is an explosive that creates a radial explosion. It can be used to sever tubulars, including downhole casing.

A firing head is used to detonate the detonating cord in the perforating gun. The firing head may be activated by an electrical signal. Electricity may be provided by a wireline that ties into the cablehead at the top of a tool string. The electrical signal may have to travel through several components, subs, and tools before it gets to the firing head. A reliable electrical connector is needed to ensure the electrical signal can easily pass from one component to the next as it moves down the tool string. The electrical signal is typically grounded against the tool string casing. As a result, the electrical connections must be insulated from tool components that are in electrical contact with the tool string casing.

A firing head may also be used in conjunction with a setting tool. Setting tools can be used for many applications, including setting bridge plugs. Bridge plugs are often introduced or carried into a subterranean oil or gas well on a conduit, such as wire line, electric line, continuous coiled tubing, threaded work string, or the like, for engagement at a pre-selected position within the well along another conduit having an inner smooth inner wall, such as casing. The bridge plug is typically expanded and set into position within the casing. The bridge plug effectively seals off one section of casing from another. Several different completions operations may commence after the bridge plug is set, including perforating and fracturing. Sometimes a series of plugs are set in an operation called "plug and perf" where several sections of casing are perforated sequentially. When the bridge plug is no longer needed the bridge plug is reamed, often though drilling, reestablishing fluid communication with the previously sealed off portion of casing.

Setting a bridge plug typically requires setting a "slip" mechanism that engages and locks the bridge plug with the casing, and energizing the packing element in the case of a bridge plug. This requires large forces, often in excess of 20,000 lbs. The activation or manipulation of some setting tools involves the activation of an energetic material such as an explosive pyrotechnic or black powder charge to provide the energy needed to deform a bridge plug. The energetic material may use a relatively slow burning chemical reaction to generate high pressure gases. One such setting tool is the Model E-4 Wireline Pressure Setting Tool of Baker International Corporation, sometimes referred to as the Baker Setting Tool.

After the bridge plug is set, the explosive setting tool remains pressurized and must be raised to the surface and depressurized. This typically entails bleeding pressure off the setting tool by piercing a rupture disk or releasing a valve.

SUMMARY OF EXAMPLE EMBODIMENTS

An example embodiment may include a tool for use downhole including a firing head, a setting tool, a power charge cartridge assembly disposed within the setting tool, further comprising a hollow cylindrical housing with a first end, second end, and a longitudinal axis, an energetic material disposed within the hollow cylindrical housing, an igniter disposed in the hollow cylindrical housing adjacent to the energetic material.

A variation of the example embodiment may include the igniter having an initiation charge and a heating element. The igniter may be located proximate to the first end of the cylindrical power charge. The igniter may be located proximate to the second end of the cylindrical power charge. The majority of the volume of the hollow cylindrical housing may contain energetic material. The setting tool may include a power charge chamber with a first end and a second end, and a ported sub, wherein the ported sub is coupled to the second end of the power charge chamber and slideably engaged to the second end of the hollow cylindrical housing. The heating element may be an electrical resistor. The embodiment may include an addressable switch integral with the power charge, where the addressable switch controls the application of electrical energy to the heating element.

A variation of the embodiment where the igniter is located proximate to the first end of the cylindrical power charge may include an electrical hot wire protruding from the first end of the cylindrical housing and electrically coupled to the heating element. It may include an electrical ground wire connecting the heating element to the cylindrical housing. It may include an electrical ground wire protruding from the power charge cartridge assembly and electrically coupled to the heating element. It may include an electrical hot wire connecting the heating element to the cylindrical housing.

A variation of the embodiment where the igniter is located proximate to the second end of the cylindrical power charge may include an electrical hot wire protruding from the first end of the cylindrical housing and electrically coupled to the heating element. It may include an electrical ground wire connecting the heating element to the cylindrical housing. It may include an electrical ground wire protruding from the power charge cartridge assembly and electrically coupled to the heating element. It may include an electrical hot wire connecting the heating element to the cylindrical housing.

An example embodiment may include a power charge cartridge assembly comprising a cylindrical housing with a first end and a second end, an energetic material disposed within the cylindrical housing, and an igniter disposed in the cylindrical housing adjacent to the energetic material.

A variation of the example embodiment may include the igniter having an initiation charge and a heating element. The heating element may be an electrical resistor. The igniter may be proximate to the first end of the cylindrical power charge. The igniter may be proximate to the second end of the cylindrical power charge. The embodiment may include an addressable switch integral with the power charge, wherein the addressable switch controls the application of electrical energy to the heating element.

A variation of the embodiment where the igniter is located proximate to the first end of the cylindrical power charge may include an electrical hot wire protruding from the first end of the cylindrical housing and electrically coupled to the heating element. It may include an electrical ground wire connecting the heating element to the cylindrical housing. It may include an electrical ground wire protruding from the power charge cartridge assembly and electrically coupled to the heating element. It may include an electrical hot wire connecting the heating element to the cylindrical housing.

A variation of the embodiment where the igniter is located proximate to the second end of the cylindrical power charge may include an electrical hot wire protruding from the first end of the cylindrical housing and electrically coupled to the heating element. It may include an electrical ground wire connecting the heating element to the cylindrical housing. It may include an electrical ground wire protruding from the power charge cartridge assembly and electrically coupled to the heating element. It may include an electrical hot wire connecting the heating element to the cylindrical housing.

An example embodiment may include a method for using a power charge in a downhole tool including assembling a power charge cartridge assembly with a heating element disposed therein, installing the power charge cartridge assembly in a power charge housing, coupling the power charge housing to a ported sub, lowering the assembled power charge cartridge assembly housing to a predetermined location in a wellbore, and electrically charging the heating element to ignite the power charge.

A variation of the disclosed method may include coupling the power charge housing to a setting tool. It may include coupling the power charge cartridge assembly to a setting tool. It may include coupling the setting tool to a firing head. It may include setting a bridge plug at the predetermined location. It may include detonating a shaped charge at the predetermined location. It may include moving the downhole tool to a second predetermined location after igniting the power charge with the heating element.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims.

Figure 1:
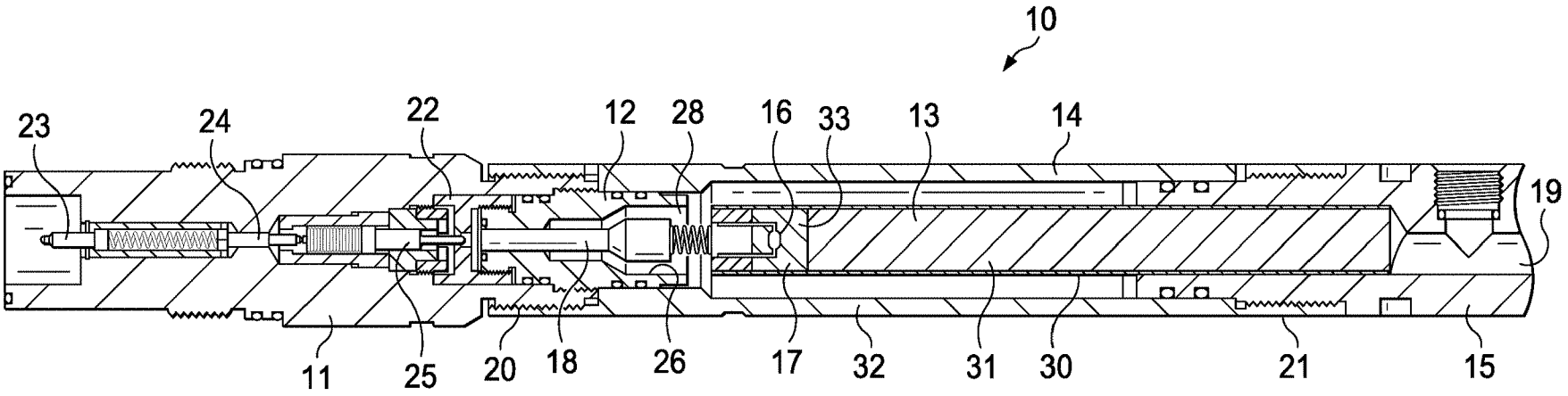
FIG. 1 shows a side view cutaway of a power charge cartridge assembly.

An example embodiment is shown in FIG. 1 depicting a portion of a tool string 10 that has a firing head 11 and a setting tool 32 connected by threaded connection 20. The firing head 11 receives an electrical signal via contact pin 23 through contact rod 24 and into electrical pin 25. Contact pin 23, contact rod 24, and electrical pin 25 are all electrically insulated from the firing head housing. Electrical pin 25 travels through the adaptor 22 and makes electrical contact with contact pin 18. Contact pin 18 resides in cavity 28 within contact sub 12. Contact pin 18 in this example uses a spring loaded electrical contact to put it in electrical contact with heating element 16. Contact sub 12 is in the first bore 26 of the power charge chamber 14.

The power charge cartridge assembly 31 is located within the power charge chamber 14. The power charge cartridge assembly 31 includes a cylindrical housing 30 that contains the energetic material 13, the initiator charge 17, and a heating element 16 embedded in the initiator charge 17. The combination of the heating element 16 and the initiator charge 17 forms an igniter 33. The heating element 16 may be an electrical resistor. An addressable switch connected to the heating element 16 may be embedded in the power charge cartridge assembly.

The heating element 16 may receive current from the contact pin 18 via the spring loaded electrical contact and then ground out to the outer casing of the power charge chamber 14. The outer housing of the tool string 10 serves as an electrical ground. The hot wire may be directly through the power charge cartridge assembly 31 and into the heating element 16. Then the heating element 16 may ground out to the power charge chamber 14. The current may be supplied via the cylindrical housing 30 to the heating element 16 and then ground out to power charge chamber 14 via a wire. Alternatively, both the hot and the ground wires may be fed through the housing 30 and connect directly to the heating element 16. Alternatively, the hot wire may feed into the cylindrical housing 30, connect to the heating element 16, and then the heating element 16 may ground to the cylindrical housing 30. The distal end 21 of the power charge chamber 14 is coupled to a ported sub 15. When the heating element 16 is energized, it ignites the initiator charge 17 by heating due to electrical resistance, which in turn ignites the power charge 13, and gases expand through the vent bore 19 on the ported sub 15. Ported sub 15 then transfers the gases into the piston of the setting tool 32.

Figure 2:
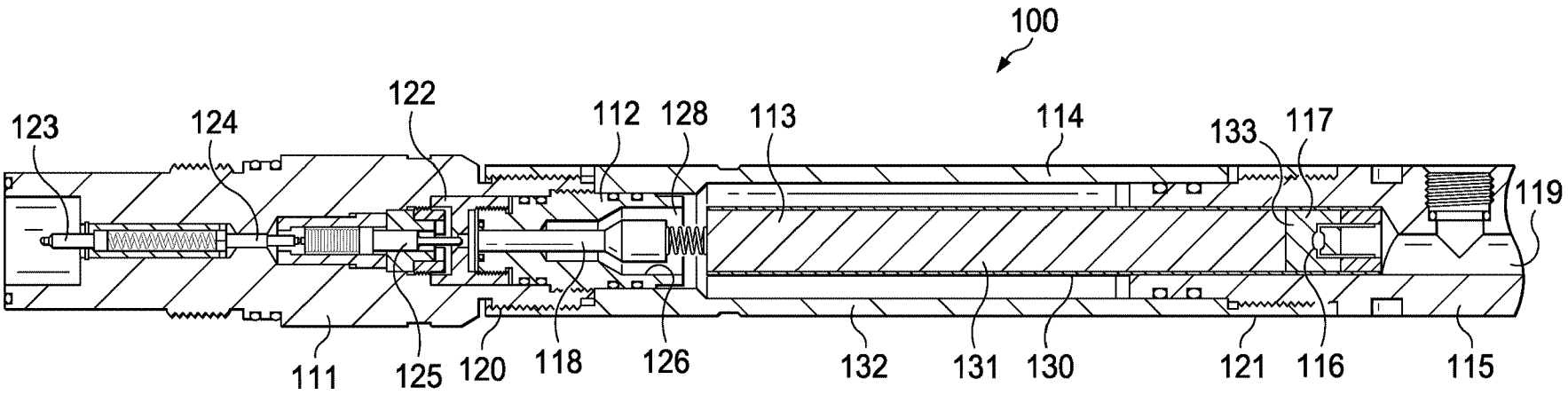
FIG. 2 shows a side view cutaway of a power charge cartridge assembly

An example embodiment is shown in FIG. 2 depicting a portion of a tool string 100. In this example, there is a firing head 111 coupled to a setting tool 132 via threaded connection 120. The power charge chamber 114 has a power charge 113. The power charge 113 includes an initiator charge 117 with an embedded heating element 116. An electrical signal can be sent to the heating element 116 via the contact pin 123, through the contact rod 124, then electrical pin 125, and through contact pin 118. The contact pin 118 is in the bore 128 of the contact sub 112. The adaptor 122 is used to locate the contact sub 112 axially between the firing head 111 and the power charge chamber 114.

The power charge cartridge assembly 131 is located within the power charge chamber 114. The power charge cartridge assembly 131 includes a cylindrical housing 130 that contains the energetic material 113, the initiator charge 117, and a heating element 116 embedded in the initiator charge 117. The combination of the heating element 116 and the initiator charge 117 is referred to as the igniter 133. The heating element 116 may be an electrical resistor. An addressable switch connected to the heating element 116 may be embedded in the power charge cartridge assembly.

The heating element 116 may receive current from the contact pin 118 via the spring loaded electrical contact and then ground out to the outer casing of the power charge chamber 114. The outer housing of the tool string 110 serves as an electrical ground. The hot wire may be directly through the power charge cartridge assembly 131 and into the heating element 116. Then the heating element 116 may ground out to the power charge chamber 114. The current may be supplied via the cylindrical housing 130 to the heating element 116 and then ground out to power charge chamber 114. Alternatively, both the hot and the ground wires may be fed through the housing 130 and connect directly to the heating element 116. The distal end 121 of the power charge chamber 114 is coupled to a ported sub 115. When the heating element 116 is energized, it ignites the initiator charge 117 due to heating from electrical resistance, which in turn ignites the power charge 113, and gases expand through the vent bore 119 on the ported sub 115. Ported sub 115 then transfers the gases into the piston of the setting tool 132.

In the configuration shown in the example embodiment of FIG. 2 the heating element 116 can ignite the initiator charge 117, which then ignites the power charge 113 from the setting tool side of the power charge cartridge assembly 131 rather than the firing head side as shown in the previous embodiment. As gases are generated by the ignited power charge 113, the gases more efficiently vent into the ported sub 115 via vent bore 119 because they do not have to travel as far through the housing 132. By igniting the power charge 113 from the bottom instead of the top, the gases can immediately start expanding and performing work instead of first building up pressure within the power charge chamber 114. This puts less stress on the tools and allows for greater reusability.

One advantage of the disclosed embodiments is that there is no longer a separate igniter to initiate the power charge. In another example the heating element may directly initiate the power charge without an igniter charge. This further reduces tool complexity since an igniter holder sub is no longer necessary.

Another advantage to the disclosed examples is that an addressable control fire switch can be connected directly to the power charge. Upon combustion, the addressable control fire switch will then be destroyed. The destroyed switch will be unable to send a signal to the surface, which would indicate that the switch was in fact destroyed and thus confirm that the power charge ignited.

The heating element in the igniter may be an electrical resistor that converts electrical energy into heat.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. Terms like wellbore, borehole, well, bore, oil well, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A tool for use downhole comprising:

a firing head;

a setting tool;

a power charge cartridge assembly disposed within the setting tool, further comprising:

tubular housing with a first end, second end, and a longitudinal axis, an energetic material disposed within the hollow tubular housing, an igniter disposed in the tubular housing adjacent to the energetic material, wherein the igniter comprises a heating element and an initiation charge.

2. The apparatus of claim 1 wherein the heating element is in direct contact with the energetic material.

3. The apparatus of claim 1 wherein the igniter is located proximate to the first end of the tubular housing.

4. The apparatus of claim 1 wherein the igniter is located proximate to the second end of the tubular housing.

5. The apparatus of claim 1 wherein the setting tool comprises a power charge chamber with a first end and a second end, and a ported sub, wherein the ported sub is coupled to the second end of the power charge chamber and slideably engaged to the second end of the tubular housing.

6. The apparatus of claim 1 wherein the heating element is a resistor.

7. The apparatus of claim 1 further comprising an addressable switch integral with the power charge cartridge assembly, where the addressable switch controls the application of electrical energy to the heating element.

8. The apparatus of claim 3 further comprising a first electrical conductor outside the first end of the tubular housing and electrically coupled to the heating element.

9. The apparatus of claim 8 further comprising a second electrical conductor connecting the heating element to the tubular housing.

10. The apparatus of claim 3 further comprising an electrical conductor outside the power charge cartridge assembly and electrically coupled to the heating element.

11. The apparatus of claim 3 further comprising a first electrical conductor connecting the heating element to the tubular housing.

12. The apparatus of claim 4 further comprising a first electrical conductor outside the first end of the tubular housing and electrically coupled to the heating element.

13. The apparatus of claim 11 further comprising a second electrical conductor connecting the heating element to the tubular housing.

14. The apparatus of claim 12 further comprising a second electrical conductor outside the power charge cartridge assembly and electrically coupled to the heating element.

15. The apparatus of claim 4 further comprising a first electrical conductor connecting the heating element to the tubular housing.

16. A power charge cartridge assembly comprising:

a tubular housing with a first end and a second end;

an energetic material disposed within the tubular housing; and an igniter disposed in the tubular housing adjacent to the energetic material, wherein the igniter comprises a heating element and an initiation charge.

17. The apparatus of claim 16 wherein the heating element is a resistor.

18. The apparatus of claim 16 wherein the igniter is proximate to the first end of the tubular housing.

19. The apparatus of claim 16 wherein the igniter is proximate to the second end of the tubular housing.

20. The apparatus of claim 16 further comprising an addressable switch integral with the power charge cartridge assembly, wherein the addressable switch controls the application of electrical energy to the heating element.

21. The apparatus of claim 18 further comprising a first electrical conductor outside the first end of the tubular housing and electrically coupled to the heating element.

22. The apparatus of claim 21 further comprising a second electrical conductor connecting the heating element to the tubular housing.

23. The apparatus of claim 21 further comprising a second electrical conductor outside the power charge cartridge assembly and electrically coupled to the heating element.

24. The apparatus of claim 18 further comprising a first electrical conductor connecting the heating element to the tubular housing.

25. The apparatus of claim 19 further comprising a first electrical conductor outside the first end of the tubular housing and electrically coupled to the heating element.

26. The apparatus of claim 24 further comprising a second electrical conductor connecting the heating element to the tubular housing.

27. The apparatus of claim 25 further comprising a second electrical conductor outside the power charge cartridge assembly and electrically coupled to the heating element.

28. The apparatus of claim 19 further comprising a first electrical conductor connecting the heating element to the tubular housing.

* * * * *